US007125827B2

(12) United States Patent
Li et al.

(10) Patent No.: US 7,125,827 B2
(45) **Date of Patent: *Oct. 24, 2006**

(54) LUBRICANT COMPOSITION HAVING A FATTY ACID, A POLYALKYLENE GLYCOL POLYMER, AND AN ANIONIC SURFACTANT, WHEREIN THE LUBRICANT IS FOR A CONVEYOR SYSTEM

(75) Inventors: Minyu Li, Oakdale, MN (US); Kimberly L. P. Hei, Baldwin, WI (US); Amy McBroom, St. Paul, MN (US)

(73) Assignee: Ecolab Inc., St. Paul, MN (US)

( * ) Notice: Subject to any disclaimer, the term of this patent is extended or adjusted under 35 U.S.C. 154(b) by 370 days.

This patent is subject to a terminal disclaimer.

(21) Appl. No.: 10/640,586

(22) Filed: Aug. 13, 2003

(65) Prior Publication Data

US 2004/0053793 A1 Mar. 18, 2004

Related U.S. Application Data

(63) Continuation-in-part of application No. 10/073,824, filed on Feb. 11, 2002, now Pat. No. 6,855,676.

(51) Int. Cl.

| | |
|---|---|
| ***C10M 173/02*** | (2006.01) |
| ***C10M 169/06*** | (2006.01) |
| ***C10M 161/00*** | (2006.01) |
| ***C10M 145/26*** | (2006.01) |
| ***C10M 141/08*** | (2006.01) |

(52) U.S. Cl. ..... 508/389; 508/403; 508/405; 508/407; 508/413; 508/415

(58) Field of Classification Search ..... 508/389
See application file for complete search history.

(56) References Cited

U.S. PATENT DOCUMENTS

| | | | |
|---|---|---|---|
| 2,825,693 A | 3/1958 | Beaubien et al. | |
| 3,350,346 A | 10/1967 | Maxson | |
| 3,352,787 A | 11/1967 | Bodach | |
| 3,372,117 A | 3/1968 | Jones et al. | |
| 3,374,171 A | 3/1968 | Davis | |
| 3,574,100 A | 4/1971 | Wetmore | |
| 3,583,914 A | 6/1971 | Garvin | |
| 3,672,977 A | 6/1972 | Dardoufas et al. | |
| 3,718,588 A | 2/1973 | Bellos | |
| 3,847,828 A | 11/1974 | Latos | |
| 3,860,521 A | 1/1975 | Aepli et al. | |
| 3,871,837 A | 3/1975 | Bedague et al. | |
| 3,929,678 A | 12/1975 | Laughlin et al. | |
| 3,950,258 A | 4/1976 | Imai et al. | |
| 4,027,512 A | 6/1977 | Treat | |
| 4,274,973 A | 6/1981 | Stanton et al. | |
| 4,288,331 A | 9/1981 | Shepley et al. | |
| 4,289,671 A | 9/1981 | Hernandez | |
| 4,414,121 A | 11/1983 | Aiello | |
| 4,436,200 A | 3/1984 | Hodlewsky et al. | |
| 4,521,321 A | 6/1985 | Anderson et al. | |
| 4,595,519 A | 6/1986 | Takeno et al. | |
| 4,604,220 A | 8/1986 | Stanton | |
| 4,636,321 A | 1/1987 | Kipp et al. | |
| 4,719,022 A | 1/1988 | Hyde | |
| 4,752,527 A | 6/1988 | Sanzero et al. | |
| 4,789,593 A | 12/1988 | Das | |
| 4,839,067 A | 6/1989 | Jansen | |
| 4,929,375 A | 5/1990 | Rossio et al. | |
| 5,009,801 A | 4/1991 | Wider et al. | |
| 5,062,979 A | 11/1991 | Scharf et al. | |
| 5,073,280 A | 12/1991 | Rossio et al. | |
| 5,141,802 A | 8/1992 | Parrinello et al. | |
| 5,160,646 A | 11/1992 | Scheld | |
| 5,174,914 A | 12/1992 | Gutzmann | |
| 5,182,035 A | 1/1993 | Schmidt et al. | |
| 5,244,589 A | 9/1993 | Liu et al. | |
| 5,286,300 A | 2/1994 | Hnatin et al. | |
| 5,334,322 A | 8/1994 | Williams, Jr. | |
| 5,352,376 A | 10/1994 | Gutzmann | |
| 5,391,308 A | 2/1995 | Despo | |
| 5,559,087 A | 9/1996 | Halsrud et al. | |
| 5,616,679 A | 4/1997 | Fies et al. | |
| 5,672,401 A | 9/1997 | Anglin et al. | |
| 5,681,628 A | 10/1997 | Niederst et al. | |
| 5,723,418 A | 3/1998 | Person Hei et al. | |
| 5,843,873 A * | 12/1998 | Butke et al. | 508/185 |

(Continued)

FOREIGN PATENT DOCUMENTS

| | | |
|---|---|---|
| DE | 3324475 | 1/1985 |

(Continued)

OTHER PUBLICATIONS

Gilbert, Peter, "*Conveyor Lubrication in Dairies, Breweries and Beverage Plants*", Klensan (Pty) Ltd., S.A. Food Review—Dec. 1981/Jan. 1982, pp. 27-28, 2 pages.

(Continued)

*Primary Examiner*—Matthew A. Thexton
(74) *Attorney, Agent, or Firm*—Andrew D. Sorenson; Anneliese S. Mayer

(57) ABSTRACT

A method of lubricating conveyor tracks or belts is herein described wherein the lubricant composition contains a polyalkylene glycol polymer, a fatty acid, and an anionic surfactant; also described is a lubricant composition with reduced sensitivity to low pHs. The composition may also comprise additional functional ingredients and be composed of ingredients that can be safely administered to humans and mammals.

31 Claims, 3 Drawing Sheets

U.S. PATENT DOCUMENTS

| | | | | |
|---|---|---|---|---|
| 5,863,874 | A | 1/1999 | Besse et al. | |
| 5,935,914 | A | 8/1999 | Theyssen et al. | |
| 6,214,777 | B1 | 4/2001 | Li et al. | |
| 6,288,012 | B1 | 9/2001 | Li et al. | |
| 6,342,470 | B1 | 1/2002 | Aronson et al. | |
| 6,855,676 | B1 * | 2/2005 | Li et al. | 508/532 |
| 6,967,189 | B1 * | 11/2005 | Li et al. | 508/180 |
| 2005/0059564 | A1 * | 3/2005 | Li et al. | 508/532 |

FOREIGN PATENT DOCUMENTS

| | | |
|---|---|---|
| EP | 0011730 | 6/1980 |
| EP | 0137057 | 4/1985 |
| EP | 0302705 | 2/1989 |
| EP | 0329891 | 8/1989 |
| EP | 0359330 | 9/1989 |
| WO | 92/13048 | 8/1992 |
| WO | 92/13049 | 8/1992 |
| WO | 93/18121 | 9/1993 |
| WO | 01/12759 | 2/2001 |

OTHER PUBLICATIONS

Gorton, Hugh J. Ph.D. and Taylour, Jim M. PhD. C Chem, "*The Development of New Conveyor Lubricant Technology*", MBAA Technical Quarterly, vol. 30, pp. 18-22, 1993, 5 pages.

* cited by examiner

LUBRICANT COMPOSITION HAVING A FATTY ACID, A POLYALKYLENE GLYCOL POLYMER, AND AN ANIONIC SURFACTANT, WHEREIN THE LUBRICANT IS FOR A CONVEYOR SYSTEM

CROSS REFERENCE TO RELATED APPLICATION

The present application is a continuation in part of U.S. patent application Ser. No. 10/073,824 filed Feb. 11, 2002 now U.S. Pat. No. 6,855,676, which is incorporated by reference in its entirety.

FIELD OF THE INVENTION

The invention pertains to a lubricant composition with reduced sensitivity to low pHs suitable for use on a moving surface. More particularly, the invention pertains to a conveyor lubricant composition with reduced sensitivity to low pHs that increases the lubricity of moving conveyors by lubricating the tracks or belts. Finally, the invention pertains to a conveyor lubricant with reduced sensitivity to low pHs composed of food additive ingredients.

BACKGROUND

In many industries, including, for example, the food and beverage processing industry, containers and other articles are transported from one location to another location by conveyors such as belt conveyors. In many such conveyor systems, a lubricating composition is used on the conveyor. One of the reasons that a lubricating composition is used is to facilitate movement and reduce the damage to the container resulting from mechanical impact between the containers and the rubbing action among the containers and between the containers and the belt. For example, occasionally in such systems, the containers are stopped on the conveyor due to a back up on the conveyor. While the containers are stopped, the belt is often still moved continuously. To facilitate the smooth transportation of the containers, a lubricating composition can be applied onto the surface of the conveyor belt and/or the containers.

There can be numerous challenges in providing lubricating compositions for use on conveyors. One example of a potential challenge is the variety of materials the lubricant may contact. For example, conveyors can be made of plastic, metal, or other materials, and the articles and containers being transported can likewise be made of a broad variety of materials, for example plastic, metal, glass, cardboard, paper, and the like. It is desirable that a lubricant be useful in more than just one application with one type of container and/or conveyor material.

Another potential challenge is the detrimental effects a lubricant may cause on the conveyors or on the articles and/or containers being conveyed. For instance, in some applications, the containers, or portions of the conveyors are made of thermoplastic materials. In such applications, it is desirable that the lubricating composition used be thermoplastic compatible. For example, in some applications that use fatty acids to make fatty acid soaps for use in lubricants, a high level of alkali neutralizing agent is required in order to neutralize the fatty acid in an aqueous composition. The use of higher amounts of alkali neutralizing agent, such as hydroxides and certain amines, in fatty acid soap containing lubricants, significantly increases the alkalinity of the lubricants. The increased level of alkalinity contributes to and promotes stress cracking in some thermoplastic containers, for example PET containers. The increased level of alkalinity can also contribute to and promote removal of some printed materials, such as printed codes on containers. Therefore, it is desirable that a lubricant not cause detrimental effects on the conveyors or the articles or containers.

There is also a desire for a lubricant with decreased pH sensitivity. Fatty acid based lubricants typically display decreased lubricity at low pH. This phenomenon is especially a problem in the beverage processing industry. For example, many beverages including colas, lemonades, and iced teas, have a low pH as a result of being acidic. Those commercial beverages having a pH slightly above 3 include COCA-COLA®, PEPSI-COLA®, ORANGE SLICE®, MOUNTAIN DEW®, SPRITE®, and MELLOW YELLOW®. Some are even more acidic with a pH below 3 such as MINUTE MAID LEMONADE®, MINUTE MAID ORANGE SODA®, FRUIT WORKS PINK LEMONADE®, and BRISK LEMON ICED TEA®. When acidic beverages are moved along a conveyor, they can spill and come into contact with the lubricant on the conveyor and lower the pH of the lubricant. This decrease in pH may decrease the lubricity of the lubricant. Thus it is desirable that a lubricant have decreased pH sensitivity especially in the presence of acidic beverages.

It is also desirable that conveyor lubricants that can potentially come into direct, indirect, or incidental contact with food and beverages for human consumption be composed of food additives or ingredients that can safely be consumed by humans or mammals. When a container for food or beverage is moved along a conveyor, the container touches the lubricant. The lubricant may not be rinsed off of the container before the container reaches the consumer. Consequently, there may be lubricant residue present on the container when the food or beverage is consumed. It is advantageous to have a lubricant that can safely be consumed by humans or mammals.

SUMMARY

Surprisingly, it has been discovered that including an anionic surfactant in a fatty acid based lubricant provides for a lubricant composition and methods of lubricating where the lubricant has reduced sensitivity to low pHs. The lubricant composition of the invention includes a fatty acid, a polyalkylene glycol polymer, and an anionic surfactant. The composition may optionally include other functional ingredients. The lubricant composition may be either a concentrate or a dilute solution. It has also been discovered that the lubricant composition can be made using food additive ingredients that can be consumed safely by humans or mammals.

The methods of lubricating include lubricating a moving surface and a conveyor system for transporting a container in particular by applying the lubricant composition to a surface of a belt or track of the conveyor.

These and other embodiments will be apparent to those of skill in the art and others in view of the following detailed description of some embodiments. It should be understood, however, that this summary, and the detailed description illustrate only some examples of various embodiments, and are not intended to be limiting to the invention as claimed.

DETAILED DESCRIPTION OF SOME EMBODIMENTS

Figure 1:
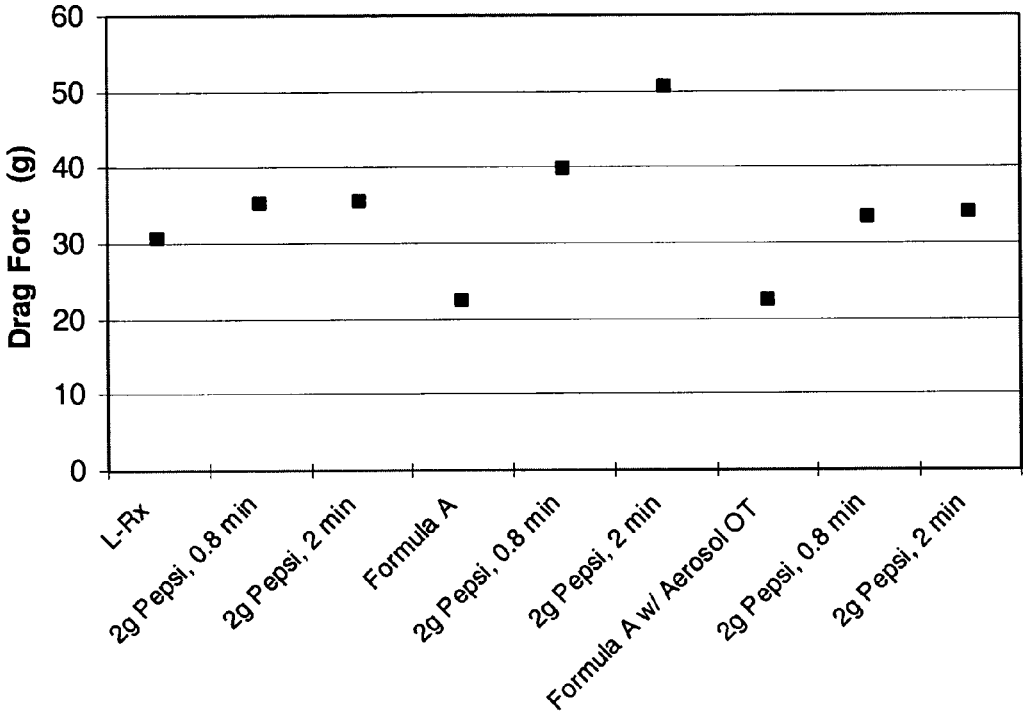
FIG. 1 shows the results of the slider lubricity tests using a mixture of the formulas in Table 3 and a PEPSI® cola beverage.

As discussed above, the invention generally relates to a lubricant composition with reduced sensitivity to low pHs, and a method of lubricating a conveyor using such a lubricant. The lubricant composition comprises a polyalkylene glycol polymer, a fatty acid, and an anionic surfactant. The lubricant can be a concentrate that can be used alone, or can be mixed with a solvent/diluent, such as water, to form a lubricant solution. In some embodiments, the composition is composed of food additive ingredients that can safely be administered to or consumed by humans and mammals. In addition, the composition can optionally include additional active or functional ingredients or components that enhance the effectiveness of the composition as a lubricant, or enhance or provide other functional aspects to the composition.

Surprisingly, it has been discovered that including an anionic surfactant in a fatty acid based lubricant reduces the sensitivity of the fatty acid lubricant at lower pH ranges. While not wanting to be held to any scientific theory, it is believed that the anionic surfactant is helping to maintain lubricity in two ways. First, the anionic surfactant balances the pH by raising the overall pH of the lubricant so that upon the addition of an acidic beverage, the pH is higher with the anionic surfactant than without the anionic surfactant. Second, the anionic surfactant is a lubricant itself. Including the anionic surfactant provides for a fatty acid based conveyor lubricant that maintains lubricity under low pH conditions such as in the presence of beverage spillage, and acidic beverage spillage in particular. The phrase "providing lubricity" means that the lubricant composition provides for a lower coefficient of friction between two surfaces when the composition is present than when the composition is not present. The phrase "maintaining lubricity in the presence of an acidic substance" means that the coefficient of friction between two surfaces when the lubricant composition is used as a lubricant does not substantially increase upon the addition of an acid and that the lubricant composition provides lubrication over substantially the entire surface of the bottle containing portions of the conveyor.

Definitions

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure.

Weight percent, percent by weight, % by weight, wt %, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4 and 5).

As used in this specification and the appended claims, the singular forms "a," "an," and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

The use of the terms "antimicrobial" and "biocide" in this application does not mean that any resulting products are approved for use as an antimicrobial agent or biocide.

Polyalkylene Glycol Polymer

The term "polyalkylene glycol polymer" includes polymers of alkylene oxides or derivatives and mixtures or combinations thereof. For example, in some embodiments, polyalkylene glycol polymers can include polymers of the following general formula, and derivatives thereof:

$$H—O—(RO)_x—H$$

wherein R is a linear or branched alkyl, and x is a positive integer, and in some embodiments is in the range of about 4 to 500 for low molecular weight polyalkylene glycol polymers, and in some embodiments up to about hundreds of thousand for high molecular weight polyalkylene glycol polymers. Some examples of commercially available lower molecular weight polyalkylene glycol polymers include CARBOWAX™ and UCON™ products available from UNION CARBIDE, and some examples of commercially available higher molecular weight polyalkylene glycol products include POLYOX™ products available from UNION CARBIDE.

As is apparent from above, the term "polyalkylene glycol polymer" also can include derivatives of such polyalkylene glycol polymers. Some examples of such derivatives can include polyalkylene glycol polymers modified by substitution on one or more of the terminal hydroxyl groups. For example, one or more of the terminal hydroxyl groups can be substituted with alkyl or acyl groups to form an ether, or a carbonyl group to form an ester. Some examples of such derivatives include compounds of the following formulas:

$$R'—O—(RO)_x—H$$

$$R'—COO—(RO)_x—H$$

wherein R' is linear or branched alkyl or aryl, and in some embodiments is in the range of $C_1$–$C_{26}$ alkyl or aryl, is in the range of $C_2$–$C_{18}$ alkyl or aryl, and is in the range of $C_{12}$–$C_{18}$ alkyl or aryl. Some specific examples of such ether and ester derivatives of polyalkylene glycol include: ETHAL SA-20, Polyoxyethylene (20) stearyl alcohol from ETHOX CHEMICALS, LUMULSE 100-S, Polyethylene glycol 1000 monostearate from LAMBENT TECHNOLOGIES, Myrj 45, Polyoxylene (8) stearate from UNIQEMA (ICI Surfactants), and DOWANOL DPM (dipropykne glycol methyl ether) available from DOW.

The polyalkylene glycol polymer component can be in the form of a homopolymer, or mixtures or combinations of homopolymers, or can include copolymers, such as block or random copolymers, or mixtures of combinations of such copolymers, or can include mixtures or combinations of homopolymers and copolymers. In some examples, the polyalkylene glycol polymers range in molecular weight from 50 to several million, from 50 to 100,000, from 50 to 20,000, and from 50 to 10,000. The polyalkylene glycol polymer components can be in liquid, paste, solid, prill, gel, capsule, powder, or pellet form.

In some particular embodiments, the polyalkylene glycol polymer includes homopolymers of polyethylene glycols, polypropylene glycols, or block and random copolymers of ethylene oxide and propylene oxide, and derivatives of mixtures of any of these. For example, block copolymers of ethylene oxide and propylene oxide are known in the art as nonionic surfactants and are commercially available. One example of a trade name for such block copolymers is PLURONICS manufactured by BASF.

One particular type of polyalkylene glycol polymer used in some embodiments includes ethylene oxide/propylene oxide copolymers wherein the polymer is prepared by the controlled addition of propylene oxide to the two hydroxyl groups of propylene glycol. Ethylene oxide is then added to sandwich this hydrophobe between hydrophilic groups, controlled by length to constitute from 10% to 80% (by weight) of the final molecule. This type of polymer is best illustrated by the following formula:

$$HO-(CH_2CH_2O)_x-(CH_2\overset{\overset{CH_3}{|}}{C}HO)_y-(CH_2CH_2O)_{x'}-H$$

The x, y, and x' in the formula have no definite integers, but depend on the amount of ethylene oxide and propylene oxide in the desired polymer. In this particular embodiment, ethylene oxide constitutes anywhere from 10 to 80 wt-%.

A second type of block copolymer in some embodiments is that prepared by adding ethylene oxide to ethylene glycol to provide a hydrophile of designated molecular weight. Propylene oxide is then added to obtain hydrophobic blocks on the outside of the molecule thereby creating another sandwich. The structure of this polymer is illustrated as follows:

$$HO-(\overset{\overset{CH_3}{|}}{C}H-CH_2O)_x-(CH_2CH_2O)_y-(CH_2\overset{\overset{CH_3}{|}}{C}H_2O)_x-H$$

The content of ethylene oxide can range from 10 to 80 wt-%.

In some specific embodiments, the block copolymers are those between the molecular weight range of 800 to 40,000 and comprise polypropylene oxide sandwiched by polyethylene oxide blocks wherein the ethylene oxide constitutes from 10 to 80 wt-% of a copolymer. One particular example of a useful lock copolymer is that polymer identified as PLURONIC® F-108, which has an average molecular weight of 14,600, a meltpour point of 57° C., is a solid at room temperature with a viscosity of 2,800 cps at 77° C., and a surface tension in dynes/cm of 41 at 25° C., @0.1%.

The polyalkylene glycol component can comprise a very broad range of weight percent of the entire composition, depending upon the desired properties. For example, for lubricant concentrate embodiments, the polyalkylene glycol polymer can comprise in the range of 1 to 99 wt.-% polyalkylene glycol polymer component of the total weight, in the range of 1 to 50 wt.-% polyalkylene glycol polymer component of the total weight, in the range of 2 to 25 wt.-% polyalkylene glycol polymer component of the total weight, and in the range of 5 to 20 wt.-% polyalkylene glycol polymer component of the total weight.

Fatty Acid

The term "fatty acid" includes any of a group of carboxylic acids that can be derived from or contained in an animal or vegetable fat or oil. Fatty acids are composed of a chain of alkyl groups and characterized by a terminal carboxyl group. The alkyl groups can be linear or branched. The fatty acid can be saturated or unsaturated. In some embodiments, the chain of alkyl groups contains from 4 to 24 carbon atoms, from 6 to 24 carbon atoms, and from 12 to 18 carbon atoms. The lubricant composition can include combinations or mixtures of different fatty acids. One particular fatty acid that is suitable is oleic acid, but as set forth above, a broad variety of other fatty acids or combinations or mixtures thereof are contemplated for use.

In at least some embodiments, at least a portion of the fatty acid remains a free fatty acid, in that it is not neutralized. In some embodiments, substantially all of the fatty acid remains a free fatty acid. As discussed above, in some previous lubricants, the use of a fatty acid component required the use of an alkali neutralizing agent, for example to neutralize the fatty acid into a fatty acid soap. Such alkali neutralizing agents would undesirably increase the alkalinity content of the lubricant. Embodiments of the invention that include a reduced amount of such neutralizing agent, or do not include any such neutralizing agents, however, can be formulated such that they do not include undesirable levels of alkalinity. For example, in some embodiments, the level of the total alkalinity is 100 ppm or less, and in some embodiments, the level of the alkalinity is 50 ppm or less. In some embodiments, such levels of alkalinity are in the use compositions, while a concentrated composition prior to dilution into a use composition may have higher levels of alkalinity.

The fatty acid component can comprise up to 50% by wt. of the final lubricant composition. For example, the lubricant concentrate composition can comprise, in the range of 0.1 to 50 wt.% fatty acid component of the total weight, in the range of 0.1 to 20 wt.% fatty acid component of the total weight, and in the range of 0.1 to 10 wt.% fatty acid component of the total weight.

Anionic Surfactant

The term "anionic surfactant" includes any surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and calcium, barium, and magnesium promote oil solubility.

As those skilled in the art understand, anionics are excellent detersive surfactants and are therefore, favored additions to heavy duty detergent compositions. Generally, however, anionics have high foam profiles which limit their use alone or at high concentration levels in cleaning systems such as CIP circuits that require strict foam control. Anionics are very useful additives to preferred compositions of the present invention. Further, anionic surface active compounds are useful to impart special chemical or physical properties other than detergency within the composition. Anionics can be employed as gelling agents or as part of a gelling or thickening system. Anionics are excellent solubilizers and can be used for hydrotropic effect and cloud point control. Additionally, anionics maintain lubricity in the presence of low pHs in accordance with the present invention.

The majority of large volume commercial anionic surfactants can be subdivided into five major chemical classes and additional sub-groups known to those of skill in the art and described in "Surfactant Encyclopedia," Cosmetics & Toiletries, Vol. 104 (2) 71–86 (1989). The first class includes acylamino acids (and salts), such as acylgluamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes phosphoric acid esters and their salts. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like. Although each of these classes of anionic surfactants can be employed in the present compositions, it should be noted that certain of these anionic surfactants may be incompatible with the enzymes incorporated into the present invention. For example, the acyl-amino acids and salts may be incompatible with proteolytic enzymes because of their peptide structure.

Anionic sulfate surfactants suitable for use in the present compositions include the linear and branched primary and secondary alkyl sulfates, alkyl ethoxysulfates, fatty oleyl glycerol sulfates, alkyl phenol ethylene oxide ether sulfates, the $C_5$–$C_{17}$ acyl-N—($C_1$–$C_4$ alkyl) and —N—($C_1$–$C_2$ hydroxyalkyl) glucamine sulfates, and sulfates of alkylpolysaccharides such as the sulfates of alkylpolyglucoside (the nonionic nonsulfated compounds being described herein).

Examples of suitable synthetic, water soluble anionic detergent compounds include the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from 5 to 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Anionic carboxylate surfactants suitable for use in the present compositions include the alkyl carboxylates, alkyl ethoxy carboxylates, and the alkyl polyethoxy polycarboxylate surfactants.

Other anionic detergents suitable for use in the present compositions include olefin sulfonates, such as long chain alkene sulfonates, long chain hydroxyalkane sulfonates or mixtures of alkenesulfonates and hydroxyalkane-sulfonates. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule). Resin acids and hydrogenated resin acids are also suitable, such as rosin, hydrogenated rosin, and resin acids and hydrogenated resin acids present in or derived from tallow oil.

The particular salts will be suitably selected depending upon the particular formulation and the needs therein.

Further examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at column 23, line 58 through column 29, line 23. Some non-limiting examples of food additive anionic surfactants include the following: dioctyl sodium sulfosuccinate (AEROSOL OT available from CYTEC), sodium linear alkyl naphaline sulfonate (PETRO LBA available from CROMPTON-WITCO), and sodium lauryl sulfate (STEPANOL WAC available from STEPAN COMPANY).

The anionic surfactant may be added to the formula as part of the conveyor lubricant. It may also be added to a lubricant as a lubricity enhancer.

The anionic surfactant component can comprise up to 50 wt.-% of the final lubricant composition. For example, the lubricant concentrate composition can comprise in the range of 0.5 to 50 wt.-% anionic surfactant component of the total weight, in the range of 0.5 to 30 wt.-% anionic surfactant component of the total weight, or in the range of 0.5 to 20 wt.-% anionic surfactant component of the total weight.

Solvent

The composition may optionally include a solvent. The solvent may be present in both the lubricant concentrate composition, and lubricant solution composition formulas. Water is the most commonly used and preferred solvent for carrying the various ingredients in the formulation of the lubricant concentrate. It is possible, however, to use a water-soluble or water compatible solvent, such as alcohols and polyols. These solvents may be used alone or with water. Some examples of suitable alcohols include methanol, ethanol, propanol, butanol, and the like, as well as mixtures thereof. Some examples of polyols include glycerol, ethylene glycol, propylene glycol, diethylene glycol, and the like, as well as mixtures thereof.

The solvent component can comprise up to 98.5 wt.-% of the final lubricant concentrate composition. For example, the lubricant concentrate composition can comprise, in the range of 0 to 98.5 wt.-% solvent component of the total weight, in the range of 0 to 80 wt.-% solvent component of the total weight, or in the range of 0 to 60 wt.-% solvent component of the total weight.

Food Additive

In the food and beverage industry, it may be desirable that any composition or chemical that comes into contact with foods and beverages, including conveyor lubricants, be suitable for human consumption such that when the composition or chemical comes into direct, indirect, or incidental contact with the food or beverage, it does not render the food or beverage unfit for consumption by humans or mammals. "Direct, indirect, or incidental contact" means that the food or beverage acquires an amount of the lubricant. "Food or beverage" as used in this application means any substance ingested by humans or mammals including liquid, solid, semisolid, composite comestible material in the form of water, carbonated beverage, a food, juice, sports beverage, snack, edible container, or carrier. The term "food additive" means that a composition or chemical may be safely administered to humans and mammals. The food additive compositions or chemicals, when combined together to make the compositions of the invention, preferably both lubricate and pass the stringent guidelines of the Federal regulations.

Examples of fatty acids that are suitable food additives include the following oleic acid, tall oil fatty acid, and refined coconut oil.

Examples of neutralization agents that are suitable food additives include sodium and potassium hydroxide, morpholine and urea.

Examples of anionic surfactants that are suitable food additives include dioctyl sodium sulfosuccinate, sodium linear alkyl napthaline sulfonate, and sodium lauryl sulfate.

Examples of solvents that are suitable food additives include benzyl alcohol, benzyl acetate, propylene glycol, and water.

Examples of chelating agents that are suitable food additives include disodium EDTA and calcium and disodium EDTA.

Examples of polyalkylene glycol polymers that are suitable food additives include CARBOWAX™ and UCON™ products available from UNION CARBIDE, or block and random copolymers of ethylene oxide and propylene oxide, and derivatives or mixtures of any of these. One example of a trade name for such block copolymers is PLURONICS® and is manufactured by BASF.

Other Ingredients

Other active ingredients may optionally be used to improve the effectiveness of the lubricant. Some non-limiting examples of such additional active ingredients can include: surfactants (cationic, anionic, amphoteric, and nonionic), neutralizing agents, stabilizing/coupling agents, detergent/dispersing agents, anti-wear agents, antimicrobial agents, foam inhibiters/generators, viscosity modifiers, sequestrants, biofilm reducing agents, dyes and odorants, anticorrosion agents, antistatic agents, secondary lubricants, and the like, and other ingredients useful in imparting a desired characteristic or functionality in the lubricant composition. The following describes some examples of such ingredients. These ingredients can be used in any amount to achieve the desired results.

Surfactants

The lubricant composition may also contain surfactants, cationic, anionic, amphoteric, and nonionic, or mixtures thereof. For a discussion on surfactants, see Kirk-Othmer, Surfactants in Encyclopedia of Chemical Technology, 19:507–593 (2d Ed. 1969), which is incorporated by reference herein.

Some examples of anionic surfactants suitable for use have already been described herein.

Some examples of cationic cosurfactants suitable for use include quaternary ammonium surfactants with one or two long chain fatty alkyl groups and one or two lower alkyl or hydroxyalkyl substituents. Preferable examples are alkylbenzyl dimethyl ammonium chloride wherein the alkyl groups are a stearyl, tallow, lauryl, myristyl moiety, and the like, and mixtures thereof.

Some examples of nonionic surfactants include polyalkylene oxide condensates of long chain alcohols such as alkyl phenols and aliphatic fatty alcohols. Some specific examples contain alkyl chains of $C_6$ to $C_{18}$. Typical examples are polyoxyethylene adducts of tall oil, coconut oil, lauric, stearic, oleic acid, and the like, and mixtures thereof. Other nonionic surfactants can be polyoxyalkylene condensates of fatty acid amines and amides having from about 8 to 22 carbon atoms in the fatty alkyl or acyl groups and about 10 to 40 alkyloxy units in the oxyalkylene portion. An exemplary product is the condensation product of coconut oil amines and amides with 10 to 30 moles of ethylene oxide. It is possible to form a block copolymer by condensing different alkylene oxides with the same fatty acid amine or amide. An example is a polyoxalkylene condensate of a long chain fatty acid amine with three blocks of oxyalkylene units wherein the first and third block consists of propylene oxide moiety and the second block consists of ethylene oxide moiety. The block copolymer may be linear or branched.

Yet another kind of nonionics are alkoxylated fatty alcohols. Typical products are the condensation products of n-decyl, n-dodecyl, n-octadecyl alcohols, and a mixture thereof with 3 to 50 moles of ethylene oxide.

Some specifically suitable nonionics for the present lubricant compositions are alkylene oxide adducts of relatively low degree of polymerization alkylglycosides. These oxyalkylated glycosides comprise a fatty ether derivative of a mono-, di-, tri-, etc. saccharide having an alkylene oxide residue. Preferable examples contain 1 to 30 units of an alkylene oxide, typically ethylene oxide, 1 to 3 units of a pentose or hexose, and an alkyl group of a fatty group of 6 to 20 carbon atoms. An oxyalkylated glycoside compares with the general formula of:

$$H—(AO)_m\text{-}G_y\text{-}O—R$$

where AO is an alkylene oxide residue; m is the degree of alkyl oxide substitution having an average of from 1 to about 30, G is a moiety derived from a reducing saccharide containing 5 of 6 carbon atoms, i.e. pentose or hexose; R is saturated or nonsaturated fatty alkyl group containing 6 to 20 carbon atoms; and y, the degree of polymerization (D.P.) of the polyglycoside, represents the number of monosaccharide repeating units in the polyglycoside, is an integer on the basis of individual molecules, but may be an noninteger when taken on an average basis when used as an ingredient for lubricants.

Some specific examples include sorbitan fatty acid esters, such as the SPANS® and the polyoxyethylene derivatives of sorbitan and fatty acid esters known as the TWEENS®. These are the polyoxyethylene sorbitan and fatty acid esters prepared from sorbitan and fatty esters by addition of ethylene oxide. Some specific examples of these are polysorbate 20, or polyoxyethylene 20 sorbitan monolaurate, polysorbate 40, or polyoxyethylene 20 sorbitan monopahnatate, polysorbate 60, or polyoxyethylene 20 sorbitan monostearate, or polysorbate 85, or polyoxyethylene 20 sorbitan triolyate.

In some embodiments, the lubricant can include a nonionic surfactant that is an alkylpolyglycoside. Alkylpolyglycosides (APGs) also contain a carbohydrate hydrophile with multiple hydroxyl groups.

APGs are fatty ether derivatives of saccharides or polysaccharides. The saccharide or polysaccharide groups are mono-, di-, tri-, etc. saccharides of hexose or pentose, and the alkyl group is a fatty group with 7 to 20 carbon atoms. Alkylpolyglycoside can be compared with the general formula of:

$$G_x\text{-}O—R$$

where G is moiety derived from a reducing saccharide containing 5 or 6 carbon atoms, i.e. pentose or hexose; and R is saturated or nonsaturated fatty alkyl group containing 6 to 20 carbon atoms; x, the degree of polymerization (D.P.) of the polyglycoside, representing the number of monosaccharide repeating units in the polyglycoside, is an integer on the basis of individual molecules, but may be a noninteger when taken on an average basis when used as an ingredient for lubricants. In some embodiments, x has the value of less than 2.5, and in some embodiments is in the range of 1 and 2.

The reducing saccharide moiety, G can be derived from pentose or hexose. Exemplary saccharides are glucose, fructose, mannose, galactose, talose, gulose, allose, altrose, idose, arabinose, xylose, lyxose and ribose. Because of the ready availability of glucose, glucose is a common embodiment in the making of polyglycosides.

The fatty alkyl group in some embodiments is a saturated alkyl group, although unsaturated alkyl fatty group can be used. It is also possible to use an aromatic group such as alkylphenyl, alkylbenzy and the like in place of the fatty alkyl group to make an aromatic polyglycoside.

Generally, commercially available polyglycosides have alkyl chains of $C_8$ to $C_{16}$ and an average degree of polymerization in the range of 1.4 to 1.6.

Neutralizing Agents

The lubricating composition can also include a neutralizing agent for various purposes, for example, to neutralize a portion of the fatty acid component. Additionally, many surfactants are most effective in the neutral pH range. Moreover, acid conditions might lead to chemical attack on certain thermoplastics and metal parts. Therefore, in some embodiments, a portion of the fatty acid component, or the available acid from the surfactants employed, e.g. the phosphates, is neutralized. However, in some embodiments, as discussed above, it is desirable to provide a composition with a relatively low level of alkalinity, for example, in compositions for use with certain thermoplastic containers or conveyors, such as PET containers. Therefore, in such embodiments, relatively low levels of alkali neutralizing agent are used. For example, in some embodiments, the level of the total alkalinity at diluted or use concentration is 100 ppm or less, and in some embodiments, the level of the alkalinity is 50 ppm or less. For example, in some embodiments, the alkalinity can be calculated as percent $CaCO_3$ at diluted or use concentration, as described in the examples below. In some embodiments, a diluted use solution can have total alkalinity levels in these ranges, while the concentrated composition prior to dilution can have higher levels of alkalinity.

Some commonly used neutralizing agents are the alkaline metal hydroxides such as potassium hydroxide and sodium hydroxide. Another class of neutralizing agent is the alkyl amines, which may be primary, secondary, or tertiary or, alkanolamines, such as monoethanolamine, diethanolamine and triethanolamine, or cyclic amines such as morpholine.

Fatty alkyl substituted amines can also be used as neutralizing agents wherein the first substitute group of the amine is a saturated or unsaturated, branched or linear alkyl group having between 8 to 22 carbon atoms, alkyl group or hydroxyalkyl group having 1 to 4 carbons, or an alkoxylate group, and the third substitute group of the amine is an alkylene group of 2 to 12 carbons bonded to a hydrophilic moiety, such as $NH_2$, —OH, $SO_3$, amine alkoxylate, alkoxylate, and the like. These amines can be illustrated by the formula:

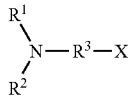

wherein $R_1$ is an alkyl group having between 8 to 22 carbon atoms, and $R_2$ is a hydrogen, alkyl group or hydroxyalkyl group having 1 to 4 carbons or an alkoxylate group, $R_3$ is an alkylene group having from 2 to 12 carbon atoms, and X is a hydrogen or a hydrophilic group such as —$NH_2$, —OH, —$SO_3$, amine alkoxylate, alkoxylate, and the like.

Examples of amines useful for neutralization are: dimethyl decyl amine, dimethyl octyl amine, octyl amine, nonyl amine, decyl amine, ethyl octyl amine, and the like, and mixtures thereof.

When X is —$NH_2$, preferable examples are alkyl propylene amines such as N-coco-1,3,diaminopropane, N-tallow-1,3,diaminopropane and the like, or mixtures thereof.

Examples of preferable ethoxylated amines are ethoxylated tallow amine, ethoxylated coconut amine, ethoxylated alkyl propylene amines, and the like, and mixtures thereof.

Stabilizing/Coupling Agents

In a lubricant composition, and the concentrate in particular, stabilizing agents, or coupling agents can be employed to keep the composition homogeneous, for example, under cold temperature. Some of the ingredients may have the tendency to phase separate or form layers due to the high concentration. Many different types of compounds can be used as stabilizers. Examples are isopropyl alcohol, ethanol, urea, octane sulfonate, glycols such as hexylene glycol, propylene glycol and the like.

Detergents/Dispersing Agents

Detergents or dispersing agents may also be added. Some examples of detergents and dispersants include alkylbenzenesulfonic acid, alkylphenols, carboxylic acids, alkylphosphonic acids, and their calcium, sodium, and magnesium salts, polybutenylsuccinic acid derivatives, silicone surfactants, fluorosurfactants, and molecules containing polar groups attached to an oil-solubilizing aliphatic hydrocarbon chain.

Some examples of suitable dispersing agents include triethanolamine, alkoxylated fatty alkyl monoamines and diamines such as coco bis (2-hydroxyethyl)amine, polyoxyethylene(5-)coco amine, polyoxyethylene(15)coco amine, tallow bis(-2 hydroxyethyl)amine, polyoxyethylene(15) amine, polyoxyethylene(5)oleyl amine and the like.

Anti-Wear Agents

Anti-wear agents can also be added. Some examples of anti-wear agents include zinc dialkyl dithiophosphates, tricresyl phosphate, and alkyl and aryl disulfides and polysulfides.

Antimicrobial Agents

Antimicrobial agents can also be added. Some useful antimicrobial agents include disinfectants, antiseptics, and preservatives. Some non-limiting examples include phenols including halo- and nitrophenols and substituted bisphenols such as 4-hexylresorcinol, 2-benzyl-4-chlorophenol and 2,4,4'-trichloro-2'-hydroxydiphenyl ether, organic and inorganic acids and its esters and salts such as dehydroacetic acid, peroxycarboxylic acids, peroxyacetic acid, methyl p-hydroxy benzoic acid, cationic agents such as quaternary ammonium compound, phosphonium compounds such as tetrakishydroxymethyl phosphonium sulphate (THPS), aldehydes such as glutaraldehyde, antimicrobial dyes such as acridines, triphenylmethane dyes and quinines and halogens including iodine and chlorine compounds.

Foam Inhibiters/Generators

Foam inhibitors or foam generators can also be used. Some examples of foam inhibitors include methyl silicone polymers. Some examples of foam generators include surfactants such as nonionic, cationic, and amphoteric compounds.

Viscosity Modifiers

Viscosity modifiers can also be used. Some examples of viscosity modifiers include pour-point depressants and viscosity improvers, such as polymethacrylates, polyisobutylenes polyacrylamides, polyvinyl alcohols, polyacrylic acids, high molecular weight polyoxyethylenes, and polyalkyl styrenes.

Sequestrants

Where soft water is unavailable and hard water is used for the dilution of the lubricant concentrate, there is a tendency for the hardness cations, such as calcium, magnesium, and ferrous ions, to reduce the efficacy of the surfactants, and even form precipitates when coming into contact with ions such as sulfates, and carbonates. Sequestrants can be used to form complexes with the hardness ions. A sequestrant molecule may contain two or more donor atoms which are capable of forming coordinate bonds with a hardness ion. Sequestrants that possess three, four, or more donor atoms are called tridentate, tetradentate, or polydentate coordinators. Generally the compounds with the larger number of donor atoms are better sequestrants. The preferable sequestrant is ethylene diamine tetracetic acid (EDTA), such as Versene products which are $Na_2EDTA$ and $Na_4EDTA$ sold by Dow Chemicals. Some additional examples of other sequestrants include: iminodisuccinic acid sodium salt, trans-1,2-diaminocyclohexane tetracetic acid monohydrate, diethylene triamine pentacetic acid, sodium salt of nitrilotriacetic acid, pentasodium salt of N-hydroxyethylene diaamine triacetic acid, trisodium salt of N,N-di(beta-hydroxyethyl)glycine, sodium salt of sodium glucoheptonate, and the like.

Biofilm Reducing Agents

Biofilm reducing agents may optionally be included in the composition. Biofilms are a biological matrix formed on surfaces that contact water. Biofilms usually contain pathogens such as harmful bacteria. These pathogens are protected by the matrix from typical biocides and are therefore harder to kill than most pathogens. Biofilm growth and removal depend on several factors including the surface composition, and chemical composition of the surrounding environment.

There are several ways of removing biofilms including physically, chemically, and biologically. Examples of ways to physically remove biofilms include using magnetic fields, ultra sound, and high and low electrical fields. Physically removing the biofilms can be combined with chemical or biological methods of removing the biofilm. Examples of chemical and biological ways of removing biofilms include using a biofilm reducing agent. Examples of biofilm reducing agents are chelating agents such as EDTA and EGTA, chlorine, iodine, hydrogen peroxide, and antimicrobial proteins such as nisin such as that produced by *Lactococcus lactus*. Chelating agents destabilize the outer cell membrane of the biofilm. Chlorine, iodine, and hydrogen peroxide remove biofilms by depolymerizing the matrix.

Biocides or antimicrobial agents are also an effective as biofilm reducing agents. Examples of biocides or antimicrobial agents that are effective include iodophores; phenols including halo- and nitrophenols and substituted bisphenols such as 4-hexylresorcinol,2-benzyl-4-chlorophenol and 2,4,4'-trichloro-2'-hydroxydiphenyl ether; quaternary ammonium compounds and other cationic compounds; cationic surfactants such as alkyl and benzyl quaternary compounds like N-alkyl ($C_{12}$–$C_{18}$) dimethylbenzyl ammonium chloride monohydrate, dimethyl didecyl ammonium chloride, and N-alkyl and ($C_{12}$–$C_{14}$)dimethyl I-napthylmethyl ammonium chloride; organic and inorganic acids and its esters and salts such as dehydroacetic acid, peroxycarboxylic acids, peroxyacetic acid, methyl p-hydroxy benzoic acid; aldehydes such as glutaraldehyde; antimicrobial dyes such as is acridines, triphenylmethane dyes and quinones and halogens.

Dyes and Odorants

Various dyes and odorants including perfumes and other aesthetic enhancing agents may also be included in the composition. Dyes may be included to alter the appearance of the composition, as for example, any water soluble or product soluble dye, any FD&C approved dye, Direct Blue 86 (Miles), Fastusol Blue (Mobay Chemical Corp), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keyston Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the composition include for example terpenoids such as citronellol, aldehydes such as amyl cinnamaldehyde, a jasmine such as C1S-jasmine orjasmal, vanillin, and the like.

Anticorrosion Agents

The composition may optionally include an anticorrosion agent. Anticorrosion agents provide compositions that generate conveyor surfaces that are shiner and less prone to biofilm buildup than conveyor surfaces that are not treated with lubricants having anticorrosion agents. Preferred anticorrosion agents which can be used according to the invention include phosphonates, phosphonic acids, triazoles, organic amines, sorbitan esters, carboxylic acid derivatives, sarcosinates, phosphate esters, zinc, nitrates, chromium, molybdate containing components, and borate containing components. Exemplary phosphates or phosphonic acids are available under the name DEQUEST (i.e., DEQUEST 2000, DEQUEST 2006, DEQUEST 2010, DEQUEST 2016, DEQUEST 2054, DEQUEST 2060, and DEQUEST 2066) from Solutia, Inc. SOLUTIA, INC. of St. Louis, Mo. Exemplary triazoles are available under the name COBRATEC (i.e., COBRATEC 100, COBRATEC TT-50-S, and COBRATEC 99) from PMC SPECIALTIES GROUP, INC. of Cincinnati, Ohio. Exemplary organic amines include aliphatic amines, aromatic amines, monoamines, diamines, triamines, polyamines, and their salts. Exemplary amines are available under the names AMP (i.e. AMP-95) from ANGUS CHEMICAL COMPANY of Buffalo Grove, Ill.; WGS (i.e., WGS-50) from JACAM CHEMICALS, LLC of Sterting, Kansas; DUOMEEN (i.e., DUOMEEN O and DUOMEEN C) from AKZO NOBEL CHEMICALS, INC. of Chicago, Ill,; DETHOX AMINE (C SERIES and T SERIES) from DEFOREST ENTERPRISES, INC. of Boca Raton, Fla.; DERIPHAT series from Henkel Corp. of Ambler, Pa.; and MAXHIB (AC SERIES) from CHEMAX, INC. of Greenville, S.C. Exemplary sorbitan esters are available under the name CALGENE (LA-SERIES) from Calgene CALGENE CHEMICAL INC. of Skokie, Ill. Exemplary carboxylic acid derivatives are available under the name RECOR (i.e., RECOR 12) from CIBA-GEIGY CORP. of Tarrytown, N.Y. Exemplary sarcosinates are available under the names HAMPOSYL from HAMPSHIRE CHEMICAL CORP. of Lexington, Mass.; and SARKOSYL from CIBA-GEIGY CORP. of Tarrytown, N.Y.

The composition optionally includes an anticorrosion agent for providing enhanced luster to the metallic portions of the conveyor.

Antistatic Agents

An antistatic agent may optionally be included in the composition. Examples of antistatic agents include long-chain amines, amides and quaternary ammonium salts; esters of fatty acids and their derivatives; sulfonic acids and alkyl aryl sulfonates; polyoxyethylene derivatives; polyglycols and their derivatives; polyhydric alcohols and their derivatives; and phosphoric acid derivatives.

Secondary Lubricants

A variety of secondary lubricants can be employed in the lubricant compositions, including hydroxy-containing compounds such as polyols (e.g., glycerol and propylene glycol); polyalkylene glycols (e.g., the CARBOWAX™ series of polyethylene and methoxypolyethylene glycols, commercially available from UNION CARBIDE CORP. and DOWANOL DPM (dipropylene glycol methyl ether) available from DOW); linear copolymers of ethylene and propylene oxides (e.g., UCON™ 50-HB-100 water-soluble ethylene oxide:propylene oxide copolymer, commercially available from UNION CARBIDE CORP.); and sorbitan esters (e.g., TWEEN® series 20, 40, 60, 80 and 85 polyoxyethylene sorbitan monooleates and SPAN® series 20, 80, 83 and 85 sorbitan esters, commercially available from ICI SURFACTANTS). Other suitable secondary lubricants include phosphate esters, amines and their derivatives, and other commercially available secondary lubricants that will be familiar to those skilled in the art. Derivatives (e.g., partial esters or ethoxylates) of the above lubricants can also be employed. For applications involving plastic containers, care should be taken to avoid the use of lubricants that might promote environmental stress cracking in plastic containers.

Finally, a variety of silicone materials can be employed as a secondary lubricant, including silicone emulsions (such as emulsions formed from methyl (dimethyl), higher alkyl and aryl silicones; functionalized silicones such as chlorosilanes; amino-, methoxy-, epoxy- and vinyl-substituted siloxanes; and silanols). Suitable silicone emulsions include E2175 high viscosity polydimethylsiloxane (a 60% siloxane emulsion commercially available from Lambent Technologies, Inc.), E21456 FG food grade intermediate viscosity polydimethylsiloxane (a 35% siloxane emulsion commercially available from Lambent Technologies, Inc.), HV490 high molecular weight hydroxy-terminated dimethyl silicone (an anionic 30–60% siloxane emulsion commercially available from Dow Corning Corporation), SM2135 polydimethylsiloxane (a nonionic 50% siloxane emulsion commercially available from GE Silicones) and SM2167 polydimethylsiloxane (a cationic 50% siloxane emulsion commercially available from GE Silicones). Other silicone materials include finely divided silicone powders such as the TOSPEARL™ series (commercially available from Toshiba Silicone Co. Ltd.); and silicone surfactants such as WP30 anionic silicone surfactant, WAXWS-P nonionic silicone surfactant, QUATQ-400M cationic silicone surfactant and 703 specialty silicone surfactant (all commercially available from Lambent Technologies, Inc.). Preferred silicone emulsions typically contain from 30 wt. % to 70 wt. % water. Non-water-miscible silicone materials (e.g., non-water-soluble silicone fluids and non-water-dispersible silicone powders) can also be employed in the lubricant if combined with a suitable emulsifier (e.g., nonionic, anionic or cationic emulsifiers). Again, care should be taken to avoid the use of emulsifiers or other surfactants that promote environmental stress cracking in plastic containers.

Lubricant Composition and Use

The composition as a concentrate can either be a liquid, a solid, a paste, a gel, or an emulsion depending on the choice and concentrations of raw materials. Although lubricants can be manufactured and sold in dilute form, they are often sold as concentrates because of the ease of handling and shipping cost. A lubricant concentrate may be substantially solid, having less than 1 wt-% of a solvent for carrying the various ingredients of the lubricant.

In some embodiments it is preferable that the lubricant concentrate have a solvent. The solvent aids in the dispensing and dilution of the concentrate in water before application on the conveyor belt and thermoplastic containers.

In some embodiments, the lubricant concentrate may be diluted with a solvent to form a lubricant solution. The lubricant concentrate may be diluted into a solvent to form a lubricant solution with preferably from 100 to 100,000 ppm of the lubricant concentrate, more preferably from 500 to 50,000 ppm of the lubricant concentrate, and most preferably from 1000 to 20,000 ppm of the concentrate. In another aspect, a method of lubricating a conveyor system for transporting a container is practiced by applying diluted aqueous thermoplastic compatible lubricating composition to the surface of the conveyor. This application may be by means of spraying, immersing, brushing and the like. The dilution may be done either batchwise by adding solvent into a container with a suitable amount of the concentrate or continuously online. Online dilution is usually done by the regulated injection of a stream of concentrate into a stream of water at a steady rate. The injection of the concentrate can be achieved by a pump, for example, metering pump, although other injection means are possible. Water of varying quality, for example, tap water, soft water, and deionized water may be used. The water may also be heated.

In some other embodiments, the concentrate composition can be applied in relatively low amounts, and does not require dilution with significant amounts of solvent. In some such embodiments, the concentrate composition provides a thin, substantially non-dripping lubricating film. In contrast to dilute embodiments, such embodiments can provide drier lubrication of the conveyors, and/or containers, a cleaner and drier conveyor line and working area, and reduced lubrication usage, thereby reducing waste, cleanup, and disposal problems.

In yet some additional embodiments, it may be desirable to provide one or more of the various components of the composition in separate containers until it is desired to make the final composition. For example, the polyalkylene glycol polymer component, the anionic surfactant component, and the fatty acid component can be provided in separate containers until it is desired to make the composition. Such an arrangement allows for the separate components to be available for use in other compositions. For example, the polyalkylene glycol polymer component could be useful in a separate lubricant composition that does not include the fatty acid component. Likewise, the fatty acid component could be useful in a separate lubricant composition that does not include the polyalkylene glycol polymer component. By maintaining such components in separate containers until it is desired to combine them to make the lubricant composition containing both, the components are potentially available for use in other systems. The mixing of the components can be made in concentrates or mixed after dilution. The mixing of the dilution can be made at the point of application or before at the mechanical system of transporting the product to the intended use sites.

The lubricant composition, either concentrated or diluted, and in a solid, paste or liquid form can be applied to a conveyor system surface that comes into contact with containers, the container surface that needs lubricity, or both. Any suitable method of applying the lubricant to the conveyor surface and/or the container surface can be used. Some examples of application methods include spraying, wiping, rolling, brushing, atomizing, dipping, and the like, or a combination of any of these. The lubricant composition can be applied to the surface by continuous, intermittent, or one time application. In at least some embodiments, only portions of the conveyor that contact the containers need to be treated. Likewise, in some embodiments, only portions of the container that contact the conveyor, or in some embodiments, that contact other containers, need to be treated. The lubricant can be formulated as a permanent composition that remains on the container or conveyor throughout its useful life, or can be a semi-permanent, or temporary composition.

The surface of the conveyor that supports the containers can be made of a wide variety of materials, for example, fabric, metal, plastic, elastomer, composites, or combinations or mixtures of these materials. Any type of conveyor system used in the container field can be treated according to some embodiments of the invention. Some examples of conveyors, containers, methods of application, and the like are disclosed in International Patent Application publication number WO 01/12759, the entire disclosure of which is incorporated herein by reference for all purposes.

In some embodiments, the lubricant composition can also be formulated to include additional desirable characteristics. For example, it may be desirable to provide a lubricating composition that is has biodegradability and nontoxicity. The public is increasingly aware of the ecological problems caused by the release of man-made chemicals in the environment. More stringent governmental regulations are being implemented to respond to this public concern. Therefore, in some embodiments, the lubricating composition would desirably contain chemicals that are more biodegradable and less toxic than conventional chemicals used in lubricant compositions. In some embodiments, it may also be desirable that the lubricating composition be compatible with inks or dyes that are used on the surface of the containers. For example, it may be desirable that the lubricant composition be compatible with inks used for date code on some containers, and does not remove such ink from the containers.

It is also desirable that, in at least some embodiments, the lubricant composition maintains lubricity in low pH ranges, for example, in the presence of acidic beverage spillage. It is also desirable that, in at least some embodiments, the lubricant composition may be composed of food additive ingredients that can safely be administered to humans or mammals.

For a more complete understanding of the invention, the following examples are given to illustrate some embodiment. These examples and experiments are to be understood as illustrative and not limiting. All parts are by weight, except where it is contrarily indicated.

EXAMPLES

The following chart provides a brief explanation of certain chemical components used in the following examples:

TABLE 1

Trade Names and Corresponding Descriptions of Some Chemicals Used in the Examples

| Trademark/Chemical Name | Description | Provider |
|---|---|---|
| Pluronic F-108 | EO/PO Block Copolymer | BASF |
| Aerosol OT | Anionic Surfactant | Cytec |
| Sodium Hydroxide | 50% solution | Dow |
| Oleic Acid | 9-Octadecenoic Acid | Henkel |

TABLE 1-continued

Trade Names and Corresponding Descriptions of Some Chemicals Used in the Examples

| Trademark/Chemical Name | Description | Provider |
|---|---|---|
| Ucon 50-HB-660 | EO PO Co-polymer | Union Carbide |
| Carbowax 300 | Homopolymer | Union Carbide |
| Sul-fon-ate OA5 R | Anionic surfactant | Intertrade Holdings |
| Avanel S-74 | Anionic surfactant | BASF Corp |
| NaHNO3 | Neutralizing Agent | Multiple vendors |
| Tween 20 | Nonionic Surfactant | Uniquema (ICI) |
| Petro LBA | Anionic Surfactant | Witco |
| Sodium Hydroxide | Neutralizing agent | Henkel |
| Sodium Lauryl Sulfate | Anionic Surfactant | Multiple vendors |
| Morpholine | Cyclic chemical with formula $C_4H_9NO$ | BASF Corp |
| Disodium EDTA | Chelating Agent | Dow |
| Lubodrive Rx | | Ecolab |

Additionally, in some of the following examples, the lubricity of some of the lubricants was determined using the following testing method.

Slider Lubricity Test

The lubricity was tested as follows. The lubricity test was done by measuring the drag force (frictional force) of a weighted cylinder (228 g) riding on a rotating disc, wetted by the test sample. The material for the cylinder is mild steel, glass, or plastic and for the rotating disc stainless steel or delrin. The drag force, using an average value, was measured with a solid state transducer, which is connected to the cylinder by a thin flexible string. The weight of the cylinder made from the same material is consistent for all the measurements.

The drag force is directly related to the friction coefficient of the lubrication. A higher drag force indicates a higher coefficient of friction or a poorer lubricity. A good lubricant would have a typical drag force less than 45.

Example 1

The first example shows the impact of an acidic beverage on formulated lubricants on a metal surface. A slider lubricity test was performed for this sample. The original formula, Formula A, consists of fatty acid, polyalkylene glycol polymers, water, morpholine, a neutralizing agent, and a few other ingredients. Formula A was compared with Formula A plus AEROSOL OT, an anionic surfactant. Table 3 shows the formulas that were tested. The ingredients are listed in grams. These samples were diluted and mixed with PEPSI® cola soda and run on the slider to look for lubricity changes. The samples were diluted in water to 0.5% and combined with PEPSI®. The mixture was analyzed on the slider lubricator. The results are also shown in FIG. 1.

TABLE 2

Formula A

| Ingredients | % |
|---|---|
| Pluronic F-108 18% solution in water | 12 |
| Ucon 50 HB 660 | 5 |
| Carbowax 300 | 3 |
| Tween 20 | 2 |
| Oleic Fatty Acid | 2.5 |

TABLE 2-continued

| Formula A | |
|---|---|
| Ingredients | % |
| Water | 74.25 |
| Morpholine | 0.75 |
| Disodium EDTA | 0.5 |
| Total | 100 |

TABLE 3

| Formulas | | |
|---|---|---|
| | Formula A | Formula A plus Aerosol OT |
| Formula A | 50 | 50 |
| Aerosol OT | — | 1.5 |

FIG. 1 shows the slider lubricity test results of the formulas in Table 3. The slider 10 lubricity test was conducted using a mild steel cylinder on a stainless steel disc. Each sample was tested on its own as well as with the addition of PEPSI® soda in two amounts, 0.8 milliliters and 2 milliliters. The samples were all run against Lubodrive Rx, a lubricant commercially available from Ecolab Inc., as the comparison.

The results in FIG. 1 show the impact that the addition of an acidic soda has on the lubricity. LUBODRIVE RX, L-Rx, is an industry accepted synthetic lubricant. Fatty acid is known to be an excellent lubricant for metal, however it can become very poor if the pH is reduced through the addition of soda. Formula A had very poor lubricity when PEPSI® was added. The drag force was 40g and 50g when PEPSI® was added. Formula A with AEROSOL OT performed the closest to a current industry standard LUBODRIVE-RX in that is provided lubrication in the presences of a PEPSI® product.

As previously discussed, while not wanting to be held to any scientific theory, it is believed that the anionic surfactant is helping to maintain lubricity in two ways. First, the anionic surfactant balances the pH by raising the overall pH of the lubricant so that upon the addition of an acidic beverage, the pH is higher with the anionic surfactant than without the anionic surfactant. Second, the anionic surfactant is a lubricant itself. These two functions are demonstrated particularly well in this example. With Formula A plus AEROSOL OT the starting lubricity is lower than the starting lubricity of the acceptable standard LUBODRIVE RX as well as Formula A. The addition of acidic soda causes the drag force for Formula A to increase considerably. However, Formula A plus AEROSOL OT increases but stays at an acceptable level of lubricity comparable to the standard LUBODRIVE RX. In addition to performing as good as LUBODRIVE RX, Formula A plus AEROSOL OT has the additional benefits of being compatible with PET and having the ability to be composed of food additive ingredients.

Example 2

Figure 2:
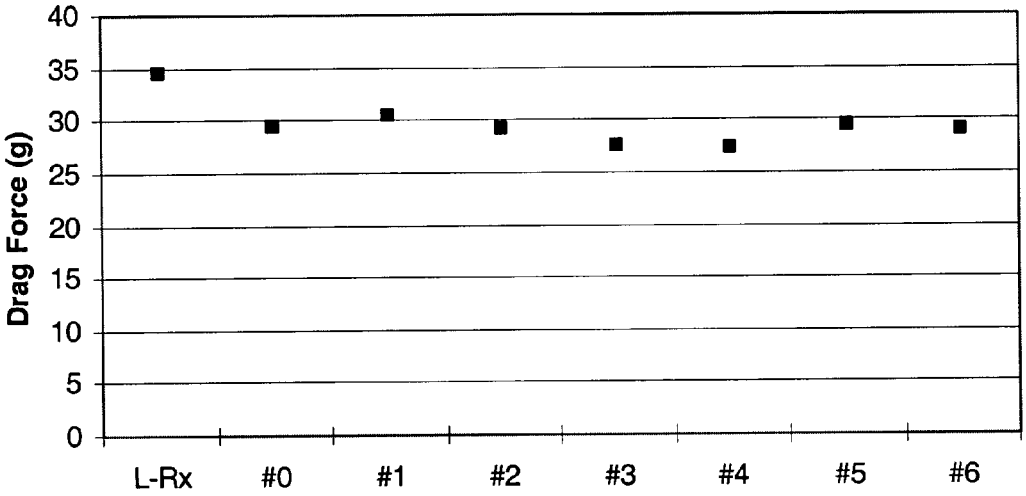
FIG. 2 shows the results of the slider lubricity tests using the formulas in Table 4 without the addition of a PEPSI® cola beverage.
Figure 3:
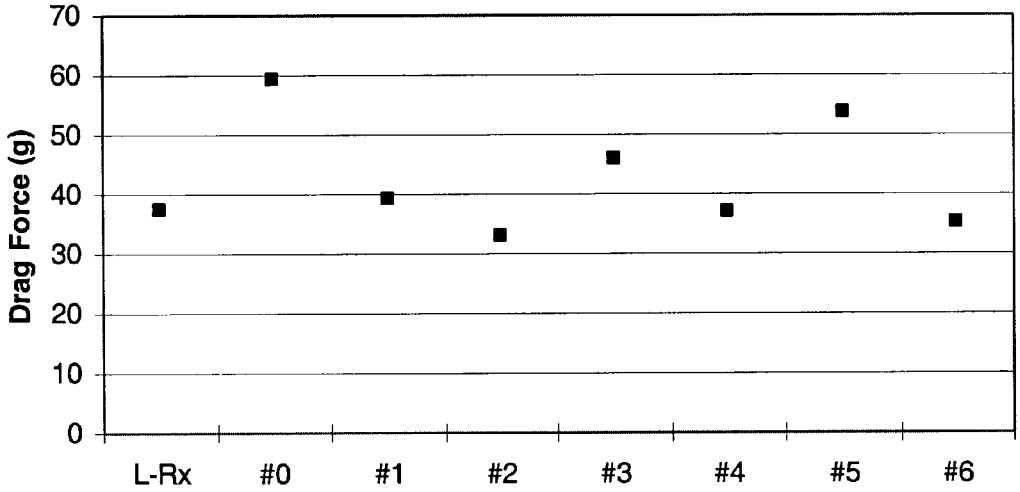
FIG. 3 shows the results of the slider lubricity tests using a mixture of the formulas in Table 4 and a PEPSI® cola beverage.

This example shows the effect of anionic additives on lubricity in the presence of an acidic beverage. Six formulas were constructed which included fatty acid, polyalkylene glycols and anionic additives. These formulas along with Formula 0 which did not contain an anionic surfactant are listed in Table 4. 0.5% solutions of the formulas were tested for lubricity (without the addition of the acidic beverage) using a mild steel cylinder on a stainless steel disc. The results are shown in FIG. 2. 0.5% solutions of the formulas were also mixed with an acidic beverage to analyze the degree of sensitivity and impact on the lubrication. The results from this test are shown in FIG. 3.

TABLE 4

| Formulas | | | | | | | |
|---|---|---|---|---|---|---|---|
| Formula | #0 | #1 | #2 | #3 | #4 | #5 | #6 |
| Pluronic F-108 18% | 12 | 12 | 12 | 12 | 12 | 12 | 12 |
| 50HB660 | 5 | 5 | 5 | 5 | 5 | 5 | 5 |
| Oleic Fatty Acid | 4.5 | 4.5 | 4.5 | 4.5 | 4.5 | 4.5 | 4.5 |
| Water | 76.5 | 71.5 | 71.5 | 74.25 | 74.25 | 74.25 | 74.25 |
| Morpholine | 1.5 | 1.5 | 1.5 | 1.5 | 1.5 | 1.5 | 1.5 |
| Disodium EDTA | 0.5 | 0.5 | 0.5 | 0.5 | 0.5 | 0.5 | 0.5 |
| Aerosol OT | 0 | 5 | 0 | 0 | 0 | 0 | 2.5 |
| SLS 30% | 0 | 0 | 5 | 0 | 0 | 0 | 2.5 |
| Petro LBA-50% | 0 | 0 | 0 | 5 | 0 | 0 | 0 |
| Sulfonate OA5-R 40% | 0 | 0 | 0 | 0 | 5 | 0 | 0 |
| Avanel S-74 35% | 0 | 0 | 0 | 0 | 0 | 5 | 0 |
| Total | 100 | 100 | 100 | 100 | 100 | 100 | 100 |

FIG. 2 shows that the addition of anionic surfactant does not adversely affect lubricity in the absence of PEPSI®. Formulas 0–6 performed as good as or better than the industry standard, LUBODRIVE RX, in the absence of PEPSI®. FIG. 3 shows that the addition of anionic surfactant aids in substantially maintaining lubricity in the presence of PEPSI®. Formulas 1–6 each contained an anionic surfactant. Formulas 1–6 all performed better than Formula 0 in the presence of PEPSI® and Formulas 2 and 6 performed better than LUBODRIVE RX.

The foregoing summary, detailed description, and examples provide a sound basis for understanding the invention, and some specific example embodiments of the invention. Since the invention can comprise a variety of embodiments, the above information is not intended to be limiting. The invention resides in the claims.

What is claimed is:

1. A method of lubricating a moving surface for conveying food or beverage, the method comprising:

a) providing a moving surface;

b) providing an acidic beverage;

c) providing a lubricant composition comprising:

i) a fatty acid;

ii) a polyalkylene glycol polymer;

iii) an anionic surfactant selected from the group consisting of sulfates, sulfonates, sulfosuccinates, sulfosuccinamates, sulfonated ester, sulfonated amides, and mixtures thereof, and iv) a solvent, and d) applying the lubricant composition to the moving surface.

2. The method of claim 1, wherein a) the fatty acid is present from about 0.0001 to about 50 wt. % of the total weight;

b) the polyalkylene glycol polymer is present from about 0.001 to about 50 wt. % of the total weight; and c) the anionic surfactant is present from about 0.0005 to about 25 wt. % of the total weight.

3. The method of claim 1, wherein the fatty acid is a $C_8$–$C_{20}$ fatty acid.

4. The method of claim 1, wherein the fatty acid comprises oleic acid, tall oil, or coco fatty acid.

5. The method of claim 1, wherein the polyalkylene glycol polymer comprises a homopolymer.

6. The method of claim 1, wherein the polyalkylene glycol polymer comprises a copolymer of ethylene oxide and propylene oxide.

7. The method of claim 1, wherein the polyalkylene glycol polymer comprises a block copolymer.

8. The method of claim 1, wherein the composition further comprises an additional functional ingredient.

9. The method of claim 8, wherein the additional functional ingredient comprises a surfactant, a neutralizing agent, a stabilizing agent, a coupling agent, a dispersing agent, an antiwear agent, an antimicrobial agent, a foam inhibitor, a foam generator, a viscosity modifier, a sequestrant, a chelating agent, a biofilm reducing agent, a dye, an anticorrosion agent, an antistatic agent, an odorant, secondary lubricant, or mixtures thereof.

10. The method of claim 1, wherein the anionic surfactant comprises dioctyl sodium sulfosuccinate, sodium linear alkylnaphthalene sulfonate, sodium lauryl sulfate, or mixtures thereof.

11. The method of claim 1, wherein the solvent comprises water, an alcohol, or a polyol.

12. The method of claim 1, wherein the composition is a solid.

13. The method of claim 1, wherein the composition is a paste.

14. The method of claim 1, wherein the composition is a liquid.

15. The method of claim 1, wherein the composition is a gel.

16. The method of claim 1, wherein the composition is an emulsion.

17. A method of lubricating a moving surface for conveying food or beverage, the method comprising:

a) providing a moving surface;

b) providing an acidic beverage;

c) providing a diluted lubricant composition comprising:

i) from about 0.0001 to about 50 wt. % of a $C_8$–$C_{20}$ fatty acid;

ii) from about 0.001 to about 50 wt. % of a polyalkylene glycol polymer;

iii) from about 0.0005 to about 25 wt. % of an anionic surfactant selected from the group consisting of sulfates, sulfonates, sulfosuccinates, sulfosuccinamates, sulfonated ester, sulfonated amides, and mixtures thereof; and iv) a solvent, wherein the diluted lubricant composition maintains lubricity in the presence of the acidic beverage; and d) applying the lubricant composition to the moving surface.

18. The method of claim 17, wherein the fatty acid comprises oleic acid, tall oil, or coco fatty acid.

19. The method of claim 17, wherein the polyalkylene glycol polymer comprises a homopolymer.

20. The method of claim 17, wherein the polyalkylene glycol polymer comprises a copolymer of ethylene oxide and propylene oxide.

21. The method of claim 17, wherein the polyalkylene glycol polymer comprises a block copolymer.

22. The method of claim 17, wherein the composition further comprises an additional functional ingredient.

23. The method of claim 22, wherein the additional functional ingredient comprises a surfactant, a neutralizing agent, a stabilizing agent, a coupling agent, a dispersing agent, an antiwear agent, an antimicrobial agent, a foam inhibitor, a foam generator, a viscosity modifier, a sequestrant, a chelating agent, a biofilm reducing agent, a dye, an anticorrosion agent, an antistatic agent, an odorant, a secondary lubricant, or mixtures thereof.

24. The method of claim 17, wherein the anionic surfactant comprises dioctyl sodium sulfosuccinate, sodium linear alkylnaphthalene sulfonate, sodium lauryl sulfate, or mixtures thereof.

25. The method of claim 17, wherein the solvent comprises water, an alcohol, or a polyol.

26. The method of claim 17, wherein the composition is a solid.

27. The method of claim 17, wherein the composition is a paste.

28. The method of claim 17, wherein the composition is a liquid.

29. The method of claim 17, wherein the composition is a gel.

30. The method of claim 17, wherein the composition is an emulsion.

31. A method of lubricating comprising:

(1) mixing a lubricant for application on to a moving surface for conveying food or beverage comprising:

a) providing i) a fatty acid;

ii) a polyalkylene glycol polymer; and iii) an anionic surfactant selected from the group consisting of sulfates, sulfonates, sulfosuccinates, sulfosuccinamates, sulfonated ester, sulfonated amides, and mixtures thereof; and b) combining the fatty acid, the polyalkylene glycol polymer, and the anionic surfactant to form a lubricant concentrate at the location where the lubricant is to be used, wherein the lubricant concentrate maintains lubricity in the presence of an acidic beverage; and (2) applying the lubricant concentrate to a moving surface.

* * * * *